US010704789B2

(12) United States Patent
Scalf

(10) Patent No.: US 10,704,789 B2
(45) Date of Patent: Jul. 7, 2020

(54) FOLDING DOOR FOR A COOKING APPLIANCE

(71) Applicant: Midea Group Co., Ltd., Beijiao, Shunde, Foshan (CM)

(72) Inventor: Eric Scalf, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 89 days.

(21) Appl. No.: 16/010,791

(22) Filed: Jun. 18, 2018

(65) Prior Publication Data

US 2019/0383496 A1 Dec. 19, 2019

(51) Int. Cl.

| | |
|---|---|
| ***F24C 15/02*** | (2006.01) |
| ***E05D 15/26*** | (2006.01) |
| *F24C 15/04* | (2006.01) |

(52) U.S. Cl.

CPC ..... *F24C 15/026* (2013.01); *E05D 15/262* (2013.01); *E05D 15/264* (2013.01); *F24C 15/023* (2013.01); *E05Y 2900/308* (2013.01); *F24C 15/04* (2013.01)

(58) Field of Classification Search

CPC .... F24C 15/026; F24C 15/027; E05D 15/262; E05D 15/264

USPC ..... 126/194

See application file for complete search history.

(56) References Cited

U.S. PATENT DOCUMENTS

| | | | | |
|---|---|---|---|---|
| 3,143,638 | A | 8/1964 | Scott | |
| 4,784,111 | A | 11/1988 | Palomba | |
| 5,375,587 | A * | 12/1994 | Ward | F24C 15/02 126/190 |
| 7,064,296 | B1 | 6/2006 | Hamed et al. | |
| 2019/0063123 | A1 * | 2/2019 | Ham | E05C 7/02 |

FOREIGN PATENT DOCUMENTS

| | | | | |
|---|---|---|---|---|
| CN | 101498465 | A | 8/2009 | |
| CN | 203531661 | U | 4/2014 | |
| DE | 4223608 | A1 | 1/1994 | |
| DE | 102012218477 | A1 | 5/2013 | |
| DE | 102012208439 | A1 * | 11/2013 | F24C 15/02 |
| DE | 102012208439 | A1 | 11/2013 | |
| KR | 20030093872 | A | 12/2003 | |
| RO | 93361 | A2 | 12/1987 | |

* cited by examiner

*Primary Examiner* — Grant Moubry
*Assistant Examiner* — Aaron H Heyamoto
(74) *Attorney, Agent, or Firm* — Middleton Reutlinger

(57) ABSTRACT

An apparatus and method of a folding door for a cooking appliance. The folding door includes two or more segments hingedly connected. The folding door may vertically fold towards the bottom of the appliance. The outer surface of the folding door may face interiorly towards the one or more cooking compartments of the cooking appliance when in the folded configuration. The cooking appliance may also include one or more tracks guiding the folding door to the folded configuration.

27 Claims, 6 Drawing Sheets

FOLDING DOOR FOR A COOKING APPLIANCE

BACKGROUND

The present embodiments relate to a folding door integrated into a cooking appliance, and particularly, but not limited to, for a gas and/or electric cooking appliance.

Typical cooking appliances with range doors involve a door that is the full height and/or width of the cooking cavity/compartment. When opened, the door projects horizontally to the appliance and users are required to lean over the front edge of the door or be positioned laterally of the door. Moreover, the inner surface of the door may have an increased temperature and may be exposed upwardly towards the user. Further, the open door creates an undesired momentum arm that may be offset by counterweights that increase cost related to materials, assembly, transportation, and installation. Thus, there is a need to allow, but is not limited to, an apparatus and method to conveniently access the cooking appliance (e.g. range top and/or cooking compartment), reduce heat exposure to the user, and/or reduce the momentum force.

SUMMARY

In some embodiments, a cooking appliance may comprise one or more cooking compartments including a top, a bottom, at least two sides, and a front door. In various embodiments, the front door may define a front opening allowing access into the one or more cooking compartments. Moreover, in some embodiments, at least one heat source may be in fluid communication with the one or more cooking compartments. In various embodiments, the front door may be hingedly connected adjacent to an outer periphery of the front opening of the one or more cooking compartments adjacent the bottom of the one or more cooking compartments. In some embodiments, the front door may include a plurality of segments hingedly connected to each other to fold upon each other in a vertical direction between the top and the bottom of the one or more cooking compartments.

In addition, in some embodiments, the plurality of segments of the front door may include an upper segment hinged to a lower segment. In various embodiments, the cooking appliance may comprise a first hinge between the upper segment and the lower segment and a second hinge between the lower segment and the outer periphery of the front opening. In some embodiments, the first hinge and second hinge may be substantially horizontal. Moreover, in various embodiments, the front door may include an outer face and an inner face, wherein when folded to an open position the outer face of the front door may be facing upwards in a direction towards the one or more cooking compartments. In some embodiments, the cooking appliance may include one or more tracks guiding the front door between a closed position and an open position. In addition, in some embodiments, the plurality of segments of the front door may include an upper segment hinged to a lower segment, and wherein the one or more tracks may maintain an upper edge of the upper segment to travel adjacent to the front opening between the top and the bottom of the one or more cooking compartments when the front door is folded between a closed position and an open position. In various embodiments, when the front door is in a folded position, the folded front door may be angled downwardly and away from the one or more cooking compartments.

In some embodiments, a cooking appliance may comprise one or more cooking compartments including a top, a bottom, at least two sides, and a segmented front door. In various embodiments, the segmented front door may define a front opening allowing access into the one or more cooking compartments. In various embodiments, at least one heat source may be in fluid communication with the one or more cooking compartments. In addition, in some embodiments, the segmented front door may be interconnected by a one or more first hinges horizontally orientated. In various embodiments, a second hinge horizontally orientated may connect the segmented front door adjacent to an outer periphery of the front opening of the one or more cooking compartments adjacent the bottom of the one or more cooking compartments. In some embodiments, the segmented front door may vertically fold upon a portion of the segmented front door from a closed position to an open position relative to the front opening. Moreover, in various embodiments, when in the closed position the segmented front door may be in an extended configuration and when in the open position the segmented front door may be in a folded configuration adjacent the bottom of the one or more cooking compartments.

In addition, in some embodiments, the segmented front door may include an outer face and an inner face, wherein when in the folded configuration in the open position the outer face of the segmented front door may be facing upwards in a direction towards the one or more cooking compartments. In various embodiments, the cooking appliance may include one or more tracks guiding the segmented front door between the closed position and the open position. In some embodiments, the segmented front door may include at least an upper segment hinged to a lower segment, and wherein the one or more tracks maintain an upper edge of the upper segment to travel adjacent to the front opening between the top and the bottom of the one or more cooking compartments when the segmented front door is folded between the extended configuration and the folded configuration. In addition, in various embodiments, when the segmented front door is in the folded configuration, the segmented front door may be angled downwardly and away from the one or more cooking compartments. In some embodiments, the cooking appliance may include one or more gaskets between adjacent segments of the segmented front door.

Further, in some embodiments, a cooking appliance may comprise one or more cooking compartments. In various embodiments, the cooking compartment may include a top, a bottom, at least two sides, and a front door. In some embodiments, the front door may define a front opening allowing access into the one or more cooking compartments. In addition, in various embodiments, at least one heat source may be in fluid communication with the one or more cooking compartments. In some embodiments, the front door may include at least an upper segment and a lower segment, each of the upper segment and the lower segment may have an upper edge and a lower edge. In various embodiments, a first hinge may hingedly connect the upper edge of the lower segment to the lower edge of the upper segment and a second hinge may hingedly connect the lower edge of the lower segment adjacent to an outer periphery of the front opening of the one or more cooking compartments adjacent the bottom of the one or more cooking compartments. Moreover, in some embodiments, the upper segment and the lower segment may vertically fold together from a closed position to an open position relative to the front opening. In various embodiments, when in the closed position the upper segment and the lower segment may be in an extended configuration and when in the open position the upper segment and the lower segment may be in a folded configuration adjacent the bottom of the one or more cooking compartments.

In addition, in some embodiments, the cooking appliance may include one or more gaskets adjacent the first hinge between the upper edge of the lower segment and the lower edge of the upper segment. In various embodiments, the front door may include an outer face and an inner face, wherein when in the folded configuration in the open position the outer face of the upper segment may be facing upwards in a direction towards the one or more cooking compartments. In addition, in some embodiments, the cooking appliance may include one or more tracks guiding the front door between the closed position and the open position. In various embodiments, the one or more tracks may maintain the upper edge of the upper segment to travel adjacent to the front opening between the top and the bottom of the one or more cooking compartments when the front door is folded between the extended configuration and the folded configuration. In some embodiments, the one or more tracks may longitudinally extend adjacent at least one of the at least two sides of the one or more cooking compartments. In various embodiments, when the front door is in the folded configuration, the front door may be angled downwardly and away from the one or more cooking compartments.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
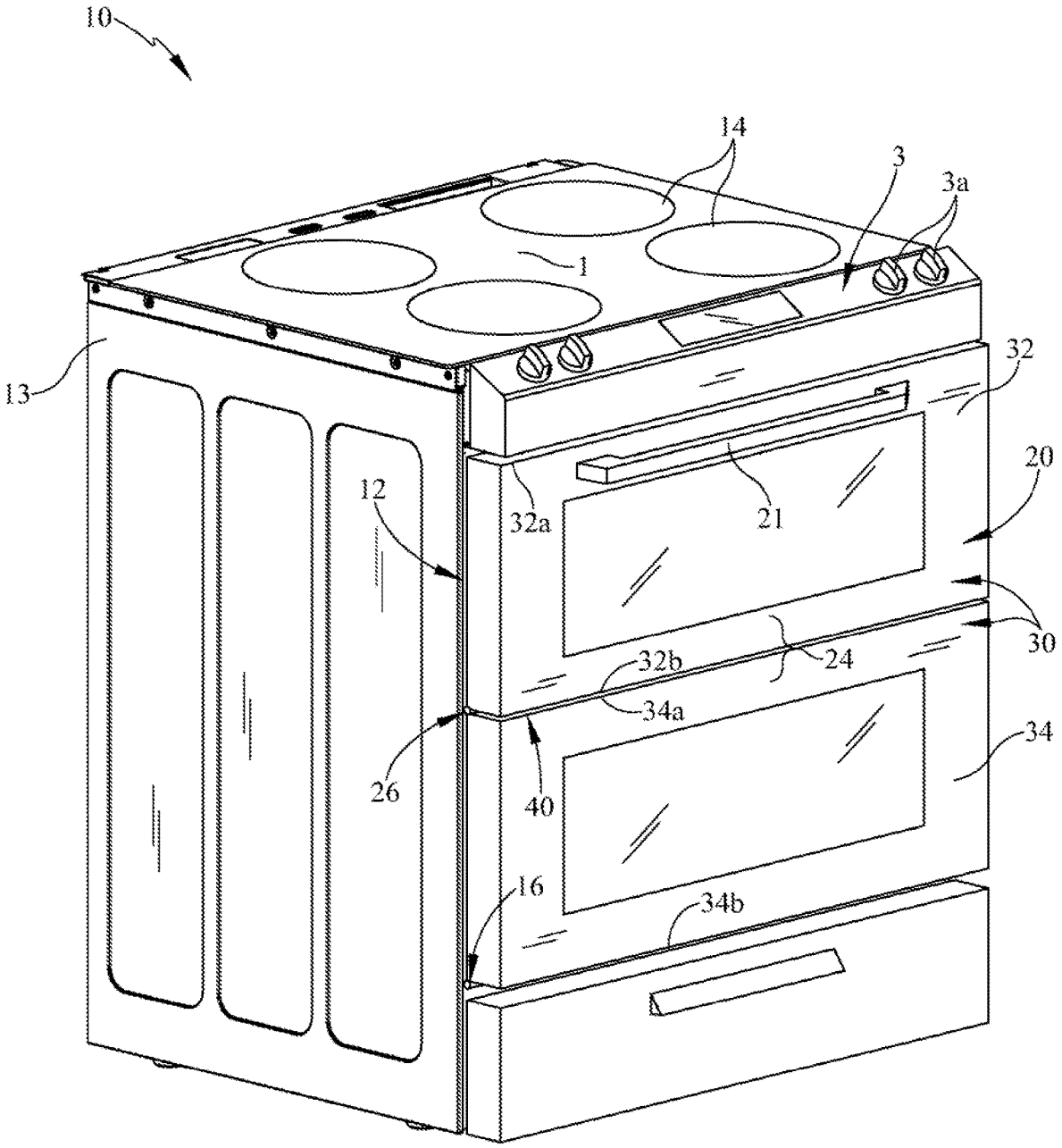
FIG. 1 is a perspective view of one embodiment of a folding door of a cooking appliance illustrating the folding door in a closed position and extended configuration over the opening of the cooking compartment.

Numerous variations and modifications will be apparent to one of ordinary skill in the art, as will become apparent from the description below. Therefore, the invention is not limited to the specific implementations discussed herein.

As illustrated in the Figures, a folding door 20 may be used in a variety of cooking appliances 10 to access one or more cooking compartments 12 or portion thereof within the appliance. The folding door 20 defines at least a portion of the front opening 12*a* into the cooking compartment 12. The folding door 20 is typically on the front side of the appliance 10 and may be positioned above a warming drawer, if used. Although the folding door 20 is shown as covering the front access into the compartment, it should be understood that the folding door may cover at least a portion of one or more cooking compartments 12 or opening 12*a* (e.g. single or double oven). The folding door 20 may be made of a variety of materials such as but is not limited to cold-rolled steel, stainless steel, pre-painted steel, etc. Moreover, each folding door 20 or one or more segments 30 thereof may include transparent panels (e.g. glass) and insulation (not shown). The folding door 20 may include a handle 21, if used, as shown in one embodiment on the upper segment 32 of the folding door 20. However, the one or more handles 21 may be in a variety of locations, quantities, constructions, sizes, and shapes. Although the cooking appliance 10 in the one embodiment shown includes a folding door with two segments on the front side of the appliance 10, it should be understood that the folding door may include segments having a variety of constructions, shapes, sizes, quantities, and materials. For example, the segments may be different or similar in shape and size. In addition, for example, the folding door may include the appliance controls 3*a* or portions thereof. Moreover, the folding door may be a portion of another or remaining portion of a cooking appliance door.

In some implementations, the cooking appliance 10 may include a cooktop 1 on a top of the housing 13. The cooking appliance 10 may further include a control panel 3 having a plurality of control knobs or controls 3*a* for controlling the gas and/or electric burners 14, if a range used, and/or cooking compartment 12. The embodiments discussed hereinafter will focus on the implementation of the hereinafter-described techniques and apparatuses within a residential cooking appliance such as cooking appliance 10, such as the type that may be used in single-family or multi-family dwellings, or in other similar applications. It will be appreciated that the herein-described techniques and apparatuses may also be used in connection with other types of cooking appliances in some embodiments. For example, the herein-described techniques may be used in commercial applications in some embodiments. Moreover, the herein-described techniques may be used in connection with various cooking appliance configurations. Implementation of the herein-described techniques within oven burners, broil burner, gas and/or electric range, slide-in oven, freestanding oven, wall oven, gas and/or electric cooktop, gas countertop range, cooking appliances with front or rear controls, etc. using a folding door would be well within the abilities of one of ordinary skill in the art having the benefit of the instant disclosure, so the embodiments are not limited to the slide-in oven implementation discussed herein. Moreover, the herein-described apparatus and techniques may be used in connection with other appliances, such as, for example, a dishwasher appliance.

As shown in the FIG. 1, the folding door 20 may be used in a home oven or cooking appliance 10, such as but not limited to a slide-in cooking range, having a housing 13 and the cooking compartment 12, such as a baking oven, convection oven, steam oven, warming drawer and the like, in the housing 13 and accessible through the folding door 20 in the front of the housing 13. In the cooking appliance 10 shown in FIG. 1, the housing 13 may have a one or more cooking compartments 12 (e.g. single or double oven). However, some embodiments may have a single compartment 12. Shelving (not shown) may be included within the cooking compartment 12. It should be understood that the one or more cooking compartments 12 and/or burners 14 may be heated by gas, electric, hybrid of gas and electric, or combination of heat sources thereof. One application of an embodiment of the cooking appliance may be for a general purpose kitchen oven. The front folding door 20 may at least partially define the one or more cooking compartment opening 12*a* into the cooking compartment 12 and be positionable between an opened position (FIGS. 2 and 3) and a closed position (FIG. 1) relative to the remainder of the housing 13 and/or one or more of the walls or sides of the cooking compartment 12. The cooking compartment 12 and/or opening 12*a* may also be defined by at least a top 12*b*, a bottom 12*c*, and at least two sides 12*d* interconnecting the top and bottom. When in the closed position, the folding door 20 or segments 30 may be an extended configuration to cover at least a portion of the opening 12*a*. In the extended configuration the segments 30 combine, unfold, or lengthen to seal the cooking compartment or opening or periphery defining the opening 12*a*. When in the closed and extended configuration, one or more gaskets 40 may seal the folding door and/or segments therebetween. In some embodiments, when in the closed position the one or more gaskets 40 and/or additional seals or gaskets may seal the door and/or segments with the remaining portion of the appliance or portions thereof. Gaskets 40 may extend between adjacent segments 30. In some embodiments, the gaskets 40 may be adjacent one or more hinges 16, 26 of the folding door and/or may contact one or more surfaces of the segments 30. The gaskets may be a variety of shapes, sizes, quantities, constructions, orientations, and locations within the door and/or appliance and still be within the scope of the invention.

Figure 2:
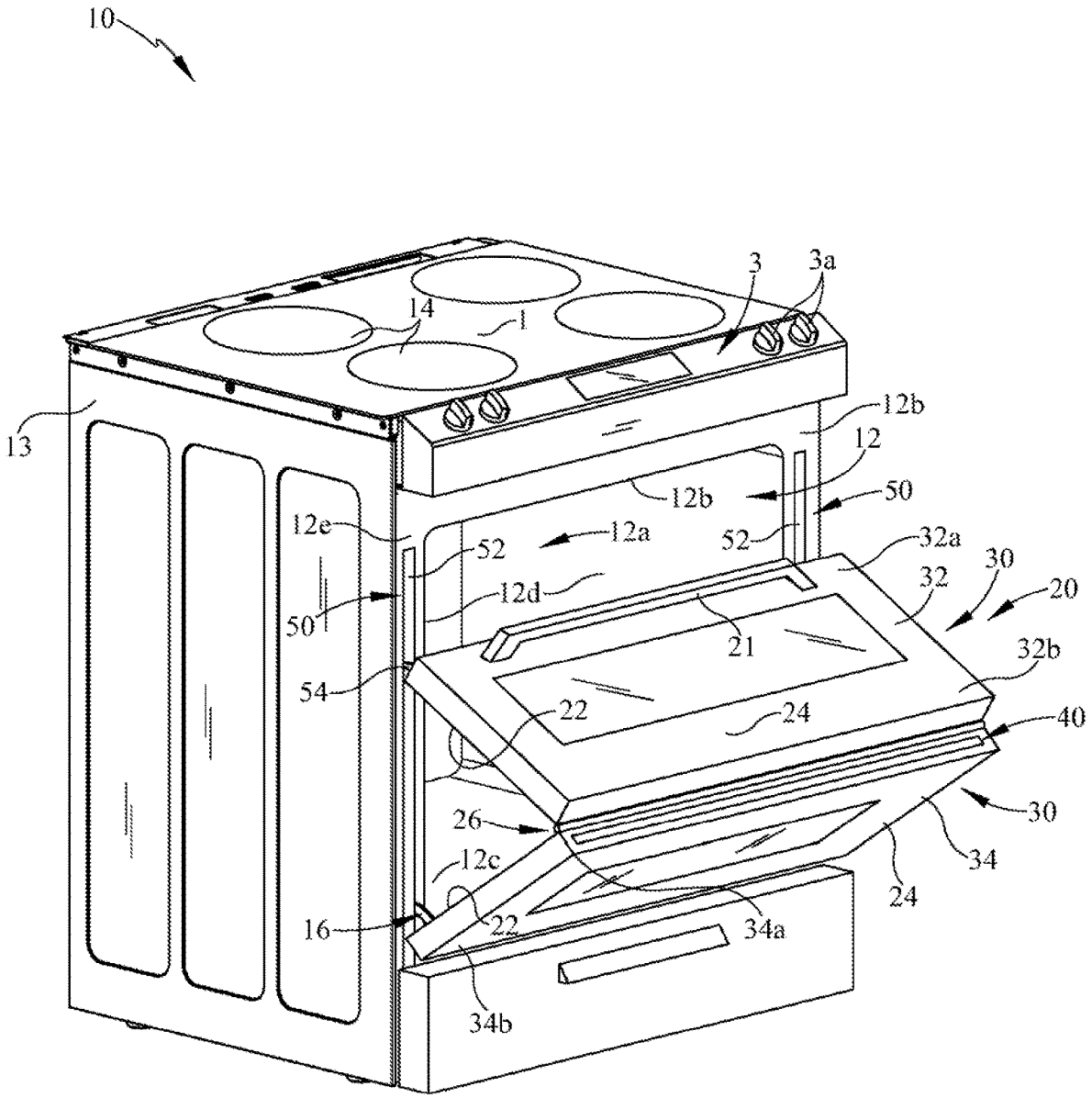
FIG. 2 is a perspective view of the embodiment of FIG. 1 with the folding door in an open position different from the closed position.
Figure 3:
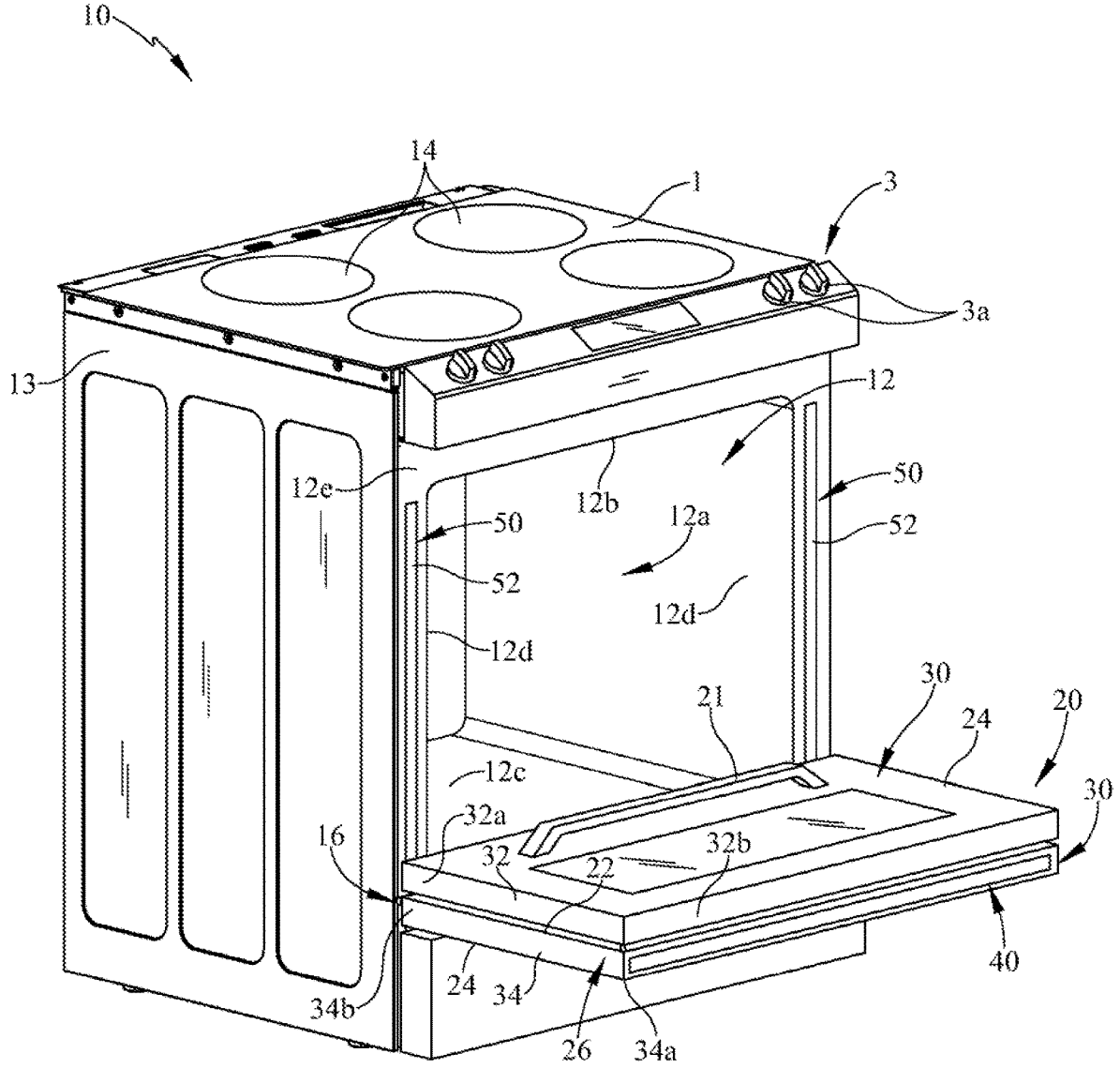
FIG. 3 is a perspective view of the embodiment of FIG. 1 illustrating the folding door in a fully open position and folded configuration providing access into the opening of the cooking compartment.
Figure 4:
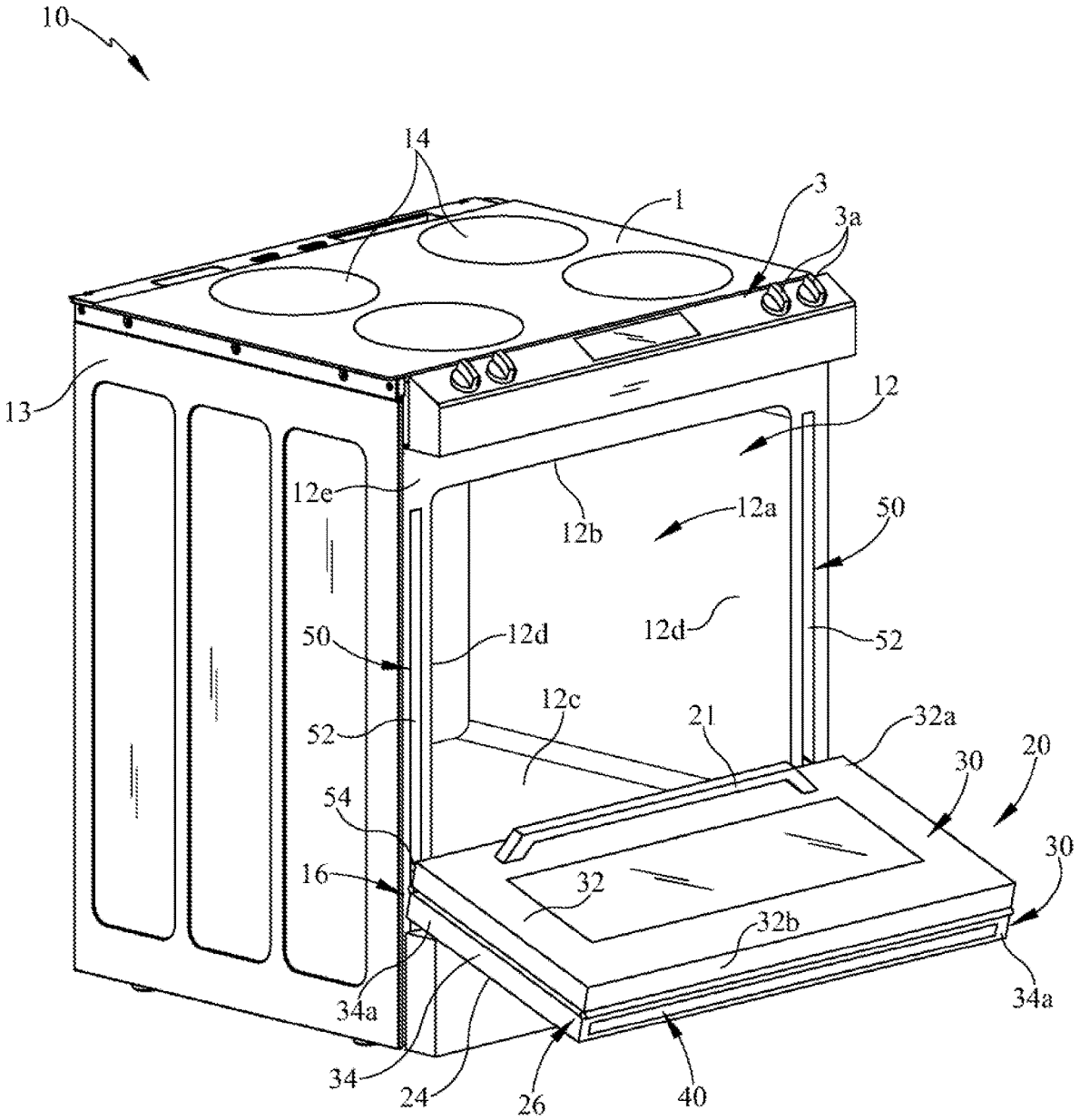
FIG. 4 is a perspective view of the embodiment of FIG. 1 illustrating the folding door in another orientation in the open position and folded configuration.
Figure 5:
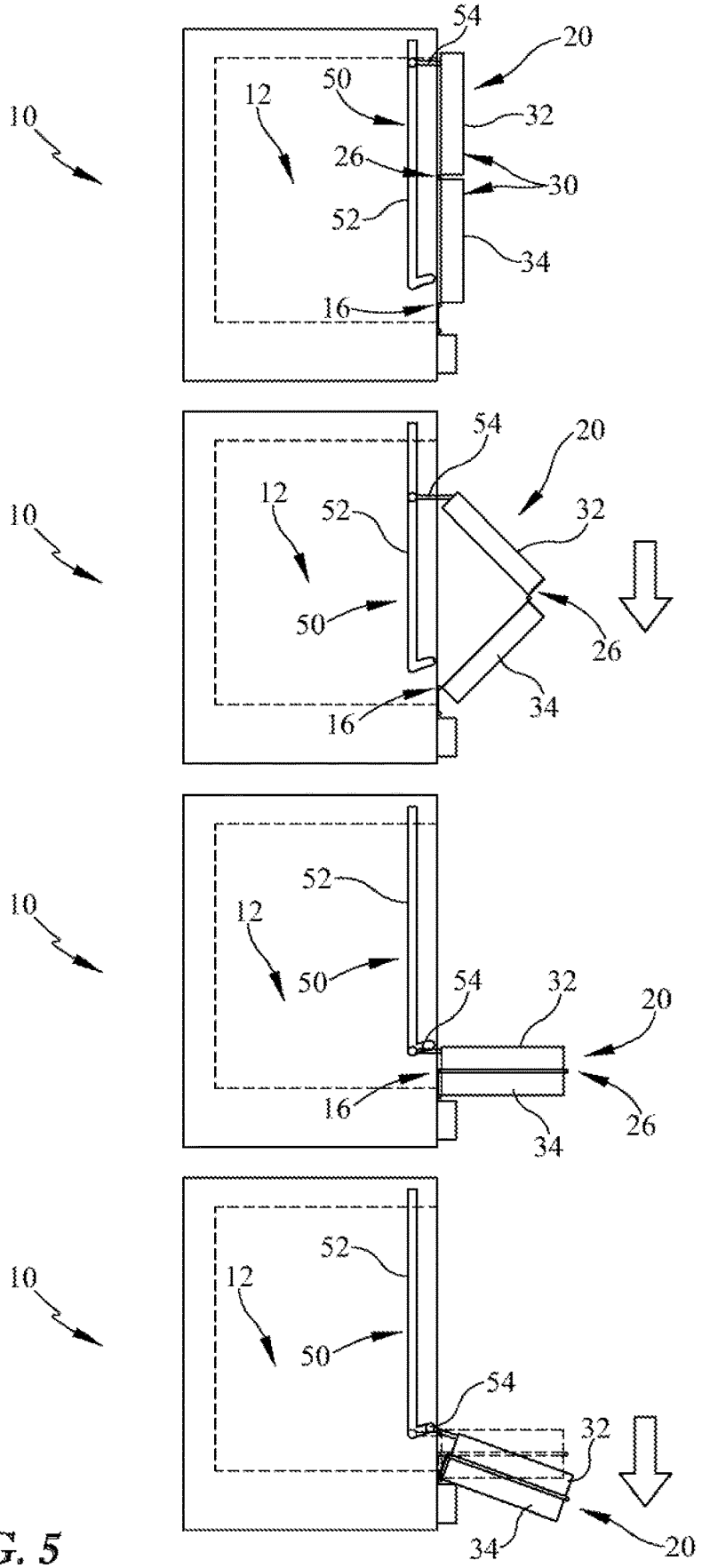
FIG. 5 is a schematic side view of the embodiment of FIG. 1 illustrating the folding door traveling between the closed position and the open positions.

In some implementations, the segments 30 of the folding door 20 fold or collapse into a folded configuration when in the open position. The open position (e.g. partially and/or fully open) is a position that is a different from the closed position. The folding door hingedly folds in the vertical direction towards the bottom of the cooking compartment or appliance. The folding door 20 may be in the folded configuration adjacent the bottom 12*c* of the cooking compartment 12 in some embodiments. As shown in the FIGS. 2-7, the folding door is hinged between the segments 30 to travel to the folded configuration. In the folded configuration, the segments may be substantially parallel to each other and/or shorter than in the extended configuration. The folding door 20 in the fully and/or partially open position may angle, pivot, or orientate relative to the cooking appliance. As shown in FIG. 3, the folding door 20 in the folded configuration may be substantially positioned 90 degrees from the plane of the opening 12*a*, cooking compartment 12, or appliance. In some embodiments, as shown in FIG. 4, the folded door 20 in the folded configuration may pivot or move to an angle below the horizontal plane. As a result, the door drops out of the way of the opening 12*a* allowing more access to the front opening 12*a*, cooking compartment 12, range 1, and/or controls 3*a*. The folded front door 20 may be angled downwardly and away from the cooking compartment. The folding door 20 includes an inner surface or face 22 and an outer surface or face 24. In the closed and extended position, at least a portion of the inner surface 22 defines the cooking compartment 12. When in the folded configuration, the outer surface or face 24 is orientated upwards and/or inwardly towards the cooking compartment. As shown in FIG. 3 in the folded configuration, the inner surfaces 22 of one or more segments are hidden, blocked, or concealed by the remaining portions of the folding door or outer surfaces 24. Moreover, the inner surfaces 22 of the segments 30 may be facing each other when folded or at least partially blocked from being exposed to the user. In other embodiments, the inner surface 22 of a segment may face at least a portion of the outer surface 24 of one or more segments 30.

In the embodiments shown, the folding door 20 is hingedly connected, by one or more hinges 16, for opening to allow frontal access into the cooking compartment 12 through an opening 12*a*. The hinges 16 may be adjacent the lower end of the folding door 20 or the lower segment 34 and hingedly connected adjacent to the bottom of the compartment 12. More specifically, in the embodiments shown, the hinges 16 may be adjacent to an outer periphery 12*e* of the front opening 12*a*. The hinges 16 may be a variety of constructions, materials, locations, orientations, shapes, sizes, and quantities and still be within the scope of the invention. For example, the hinge 16 does not have to extend the entire width of the door but may be a variety of widths or dimensions relative to the opening 12*a* and/or remaining portion of the door.

As shown in the Figures, the segmented or folding door 20 may include a plurality of segments 30 hingedly connected to each other to fold upon each other in the vertical direction towards the bottom 12*c* of the cooking compartment 12. In some embodiments, the folding door 20 may include at least an upper segment 32 hingedly connected to a lower segment 34. One or more hinges 26 may hinge the upper segment 32 to the lower segment 34. The hinges 26 may be a variety of constructions, materials, locations, orientations, shapes, sizes, and quantities and still be within the scope of the invention. Each one of the segments or panels 30 may include an upper edge 32*a*, 34*a* and a lower edge 32*b*, 34*b*, respectively. The lower edge 34*b* of the lower segment 34 may include the hinge 16 to the remaining portion of the housing 13. The hinge 26 may connect the lower edge 32*b* of the upper segment 32 or portions thereof to the upper edge 34*a* of the lower segment 34 or portions thereof. Hinge 26 and/or the hinge 16 may be substantially parallel. The hinges 16 and 26 combine to allow the folding door to fold between the extended configuration and the folded configuration. One or more of the gaskets 40 may be adjacent the hinge 26 and/or hinge 16. More specifically shown in FIG. 2, the gasket 40 may be adjacent the upper edge 34*a* of the lower segment 34 and the lower edge 32*b* of the upper segment 32. The one or more segments may be a variety of constructions, sizes, shapes, materials, quantities, positions, and orientations relative to each other and the housing 13 and still be within the scope of the invention. Moreover, one or more of the segments 30 may include the handle 21 (e.g. upper edge of the upper segment). For example, the one or more segments may be different widths (e.g. widths other than the width of the appliance or cooking compartment as shown).

Figure 6:
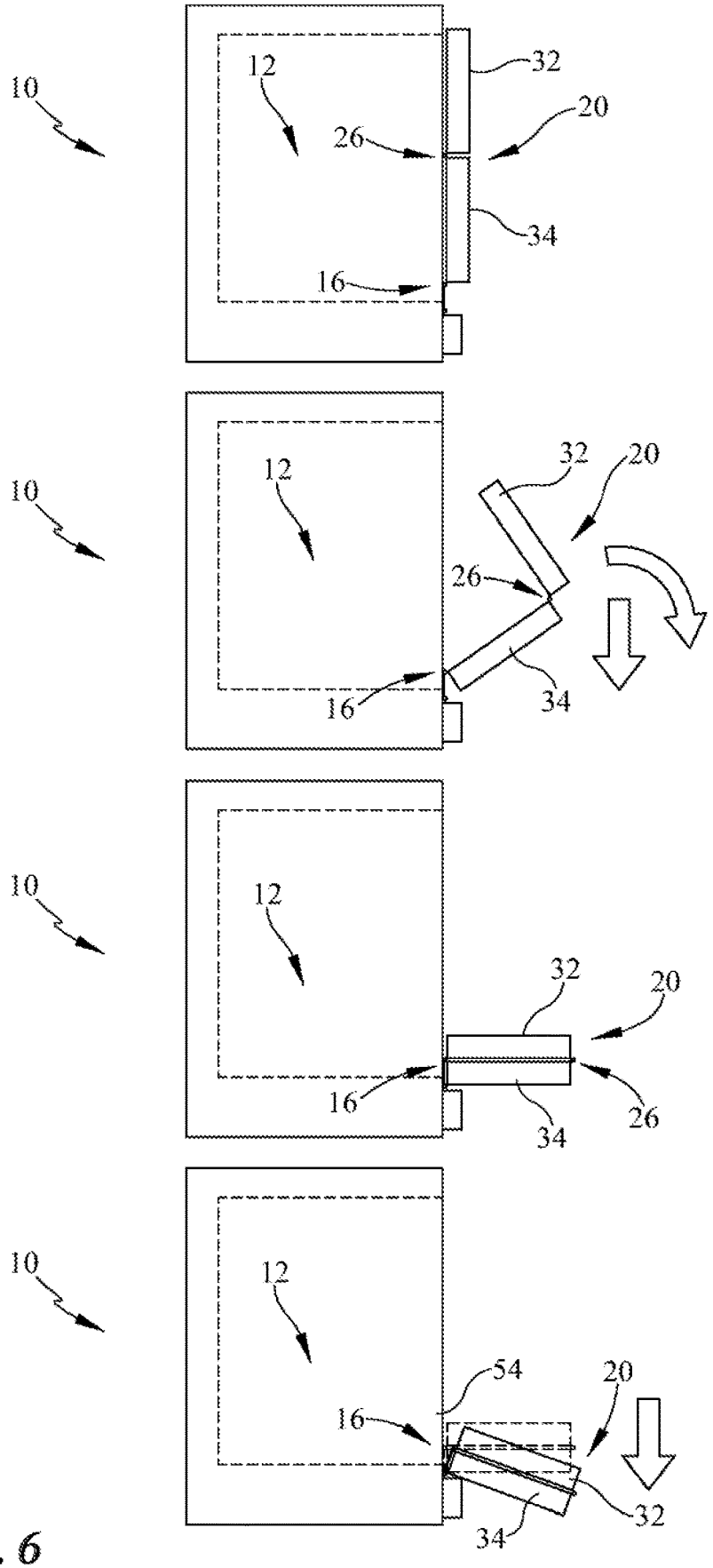
FIG. 6 is a schematic side view of another embodiment of a folding door of a cooking appliance illustrating a folding door with increased mobility than the embodiment of FIG. 1.

The folding door 20 may be connected to the remaining portion of the appliance in a variety of methods, structure, and locations. In some implementations, the folding door 20 may be connected to the remaining portion of the cooking appliance 10 in one or more locations in addition to the hinge 16. As shown in FIGS. 1-6, the embodiment of the folding door 20 may be connected to the appliance at locations in combination with the hinge 16. The hinges 16 and 26 operate together between the closed and open position controlling the motion of the folding door 20. Although the upper edge 32*a* of the upper segment 32 or upper portion of the door 20 may be shown coupled to the appliance in addition to the hinge 16, it should be understood that other segments 30 or portions thereof may be coupled to one or more portions of the cooking appliance and/or segments. Alternatively in some embodiments as shown in FIG. 6, the upper and lower edges of the folding door 20 may not be both coupled to the outer periphery 12*e* or remaining portion of the cooking appliance 10. As a result, the hinge(s) 16 and hinge(s) 26 operate independently of each other and provide a plurality of movement, motion, and paths for the folding door or segments between the closed position and the open position. As shown in the bottom sequence in FIG. 6, the folding door in the folded configuration may pivot or angle downwardly away from the opening 12*a* (e.g. below the horizontal plane).

In addition to the one or more hinges 16, the folding door 20 may be coupled to the remaining portion of the cooking appliance 10 in a variety of methods and techniques. As shown in one embodiment in FIGS. 1-5, one or more tracks 50 may guide the folding door 20 (e.g. the upper edge 32*a* and/or top of the folding door 20) between the closed position and the open position. In some embodiments, the one or more tracks 50 maintain the upper edge 32*a* of the upper segment 32 adjacent the front opening 12*a* of the cooking compartment 12 when the front door is folded between the closed and open positions. In various embodiments, as shown in FIGS. 1-3, the one or more tracks 50 may longitudinally extend adjacent one or more sides 12*d* of the cooking compartment 12 and/or outer periphery 12*e*. The track 50 may include a slot or channel 52 in the face of the outer periphery and a corresponding pin/post 54 may slidingly engage and travel within the slot 52 between the closed and open positions. In some embodiments, as shown more clearly in FIGS. 4 and 5, the track 50 (e.g. slot 52 and pin 54) may allow the folding door in one or more open and folded (e.g. fully and/or partially) positions to pivot or angle in one or more orientations (e.g. angled downwardly and away from the cooking compartment). For example, the slot 52 may include a variety of shapes or paths to allow pivoting at one or more open positions including but not limited to the fully open position.

It should be understood to one of ordinary skill that the folding door may be operated by methods in addition to or instead of manually operated. For example, one or more gears with specific ratios may operate the door in a predetermined path or movement. Moreover, a drive mechanism may operate the folding door towards the open position and/or the closed position. For example, an electric servo may be used.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A cooking appliance comprising:

one or more cooking compartments including a top, a bottom, at least two sides, and a front door, wherein the front door defines a front opening allowing access into the one or more cooking compartments;

at least one heat source in fluid communication with the one or more cooking compartments;

the front door is hingedly connected adjacent to an outer periphery of the front opening of the one or more cooking compartments adjacent the bottom of the one or more cooking compartments;

the front door includes a plurality of segments hingedly connected to each other to fold upon each other in a vertical direction between the top and the bottom of the one or more cooking compartments; and one or more tracks guiding the front door between a closed position and an open position.

2. The cooking appliance of claim 1 wherein the plurality of segments of the front door include an upper segment hinged to a lower segment.

3. The cooking appliance of claim 2 further comprising a first hinge between the upper segment and the lower segment and a second hinge between the lower segment and the outer periphery of the front opening, wherein the first hinge and second hinge are substantially horizontal.

4. The cooking appliance of claim 1 wherein the front door includes an outer face and an inner face, wherein when folded to an open position the outer face of the front door is facing upwards in a direction in front of the one or more cooking compartments.

5. The cooking appliance of claim 1 wherein the plurality of segments of the front door include an upper segment hinged to a lower segment, and wherein the one or more tracks maintain an upper edge of the upper segment to travel adjacent to the front opening between the top and the bottom of the one or more cooking compartments when the front door is folded between a closed position and an open position.

6. The cooking appliance of claim 1 wherein when the front door is in a folded position, the folded front door is angled downwardly and away from the one or more cooking compartments.

7. A cooking appliance comprising:

one or more cooking compartments including a top, a bottom, at least two sides, and a segmented front door, wherein the segmented front door defines a front opening allowing access into the one or more cooking compartments;

at least one heat source in fluid communication with the one or more cooking compartments; and the segmented front door is interconnected by a one or more first hinges horizontally orientated;

a second hinge horizontally orientated connects the segmented front door adjacent to an outer periphery of the front opening of the one or more cooking compartments adjacent the bottom of the one or more cooking compartments;

wherein the segmented front door vertically folds upon a portion of the segmented front door from a closed position to an open position relative to the front opening, wherein when in the closed position the segmented front door is in an extended configuration and when in the open position the segmented front door is in a folded configuration adjacent the bottom of the one or more cooking compartments;

one or more tracks guiding the segmented front door between the closed position and the open position.

8. The cooking appliance of claim 7 wherein the segmented front door includes an outer face and an inner face, wherein when in the folded configuration in the open position the outer face of the segmented front door is facing upwards in a direction in front of the one or more cooking compartments.

9. The cooking appliance of claim 7 wherein the segmented front door includes at least an upper segment hinged to a lower segment, and wherein the one or more tracks maintain an upper edge of the upper segment to travel adjacent to the front opening between the top and the bottom of the one or more cooking compartments when the segmented front door is folded between the extended configuration and the folded configuration.

10. The cooking appliance of claim 7 wherein when the segmented front door is in the folded configuration, the segmented front door is angled downwardly and away from the one or more cooking compartments.

11. The cooking appliance of claim 7 further comprising one or more gaskets between adjacent segments of the segmented front door.

12. A cooking appliance comprising:

one or more cooking compartments including a top, a bottom, at least two sides, and a front door, wherein the front door defines a front opening allowing access into the one or more cooking compartments;

at least one heat source in fluid communication with the one or more cooking compartments; and the front door includes at least an upper segment and a lower segment, each of the upper segment and the lower segment having an upper edge and a lower edge;

a first hinge hingedly connects the upper edge of the lower segment to the lower edge of the upper segment and a second hinge hingedly connects the lower edge of the lower segment adjacent to an outer periphery of the front opening of the one or more cooking compartments adjacent the bottom of the one or more cooking compartments; and wherein the upper segment and the lower segment vertically fold together from a closed position to an open position relative to the front opening, wherein when in the closed position the upper segment and the lower segment is in an extended configuration and when in the open position the upper segment and the lower segment is in a folded configuration adjacent the bottom of the one or more cooking compartments.

13. The cooking appliance of claim 12 further comprising one or more gaskets adjacent the first hinge between the upper edge of the lower segment and the lower edge of the upper segment.

14. The cooking appliance of claim 12 wherein the front door includes an outer face and an inner face, wherein when in the folded configuration in the open position the outer face of the upper segment is facing upwards in a direction towards the one or more cooking compartments.

15. The cooking appliance of claim 12 further comprising one or more tracks guiding the front door between the closed position and the open position.

16. The cooking appliance of claim 15 wherein the one or more tracks maintain the upper edge of the upper segment to travel adjacent to the front opening between the top and the bottom of the one or more cooking compartments when the front door is folded between the extended configuration and the folded configuration.

17. The cooking appliance of claim 15 the one or more tracks longitudinally extend adjacent at least one of the at least two sides of the one or more cooking compartments.

18. The cooking appliance of claim 12 wherein when the front door is in the folded configuration, the front door is angled downwardly and away from the one or more cooking compartments.

19. A cooking appliance comprising:

one or more cooking compartments including a top, a bottom, at least two sides, and a front door, wherein the front door defines a front opening allowing access into the one or more cooking compartments;

at least one heat source in fluid communication with the one or more cooking compartments;

the front door is hingedly connected adjacent to an outer periphery of the front opening of the one or more cooking compartments adjacent the bottom of the one or more cooking compartments;

the front door includes a plurality of segments hingedly connected to each other to fold upon each other in a vertical direction between the top and the bottom of the one or more cooking compartments; and wherein the front door includes an outer face and an inner face, wherein when folded to an open position the outer face of the front door is facing upwards in a direction in front of the one or more cooking compartments.

20. The cooking appliance of claim 19 wherein the plurality of segments of the front door include an upper segment hinged to a lower segment.

21. The cooking appliance of claim 20 further comprising a first hinge between the upper segment and the lower segment and a second hinge between the lower segment and the outer periphery of the front opening, wherein the first hinge and second hinge are substantially horizontal.

22. The cooking appliance of claim 19 further comprising one or more tracks guiding the front door between a closed position and an open position, wherein the plurality of segments of the front door include an upper segment hinged to a lower segment, and wherein the one or more tracks maintain an upper edge of the upper segment to travel adjacent to the front opening between the top and the bottom of the one or more cooking compartments when the front door is folded between a closed position and an open position.

23. The cooking appliance of claim 19 wherein when the front door is in a folded position, the folded front door is angled downwardly and away from the one or more cooking compartments.

24. A cooking appliance comprising:

one or more cooking compartments including a top, a bottom, at least two sides, and a segmented front door, wherein the segmented front door defines a front opening allowing access into the one or more cooking compartments;

at least one heat source in fluid communication with the one or more cooking compartments; and the segmented front door is interconnected by a one or more first hinges horizontally orientated;

a second hinge horizontally orientated connects the segmented front door adjacent to an outer periphery of the front opening of the one or more cooking compartments adjacent the bottom of the one or more cooking compartments;

wherein the segmented front door vertically folds upon a portion of the segmented front door from a closed position to an open position relative to the front opening, wherein when in the closed position the segmented front door is in an extended configuration and when in the open position the segmented front door is in a folded configuration adjacent the bottom of the one or more cooking compartments;

wherein the segmented front door includes an outer face and an inner face, wherein when in the folded configuration in the open position the outer face of the segmented front door is facing upwards in a direction in front of the one or more cooking compartments.

25. The cooking appliance of claim 24 further comprising one or more tracks guiding the segmented front door between the closed position and the open position, wherein the segmented front door includes at least an upper segment hinged to a lower segment, and wherein the one or more tracks maintain an upper edge of the upper segment to travel adjacent to the front opening between the top and the bottom of the one or more cooking compartments when the segmented front door is folded between the extended configuration and the folded configuration.

26. The cooking appliance of claim 24 wherein when the segmented front door is in the folded configuration, the segmented front door is angled downwardly and away from the one or more cooking compartments.

27. The cooking appliance of claim 24 further comprising one or more gaskets between adjacent segments of the segmented front door.

* * * * *